United States Patent [19]

Chow

[11] 4,295,698

[45] Oct. 20, 1981

[54] ELECTRICAL CONNECTOR HOUSING

[75] Inventor: Weichien Chow, Park Forest, Ill.

[73] Assignee: Bunker Ramo Corporation, Oak Brook, Ill.

[21] Appl. No.: 106,228

[22] Filed: Dec. 21, 1979

Related U.S. Application Data

[63] Continuation of Ser. No. 949,843, Oct. 10, 1978, abandoned.

[51] Int. Cl.[3] ..... H01R 13/42

[52] U.S. Cl. ..... 339/59 R

[58] Field of Search ..... 339/59 R, 59 M, 217 S

[56] References Cited

U.S. PATENT DOCUMENTS

| | | | |
|---|---|---|---|
| 3,271,729 | 9/1966 | Bakker | 339/217 S |
| 3,781,760 | 12/1973 | Mancini et al. | 339/59 M |
| 3,800,267 | 3/1974 | Burgess et al. | 339/217 S |
| 3,825,880 | 7/1974 | Battaglia et al. | 339/59 R |
| 3,944,312 | 3/1976 | Koenig | 339/59 R |
| 3,971,613 | 7/1976 | Kobler | 339/59 R |
| 3,982,805 | 9/1976 | Irie | 339/59 R |
| 4,013,331 | 3/1977 | Kobler | 339/59 R |

FOREIGN PATENT DOCUMENTS

| | | | |
|---|---|---|---|
| 2032995 | 1/1972 | Fed. Rep. of Germany | 339/59 R |

*Primary Examiner*—Joseph H. McGlynn

*Attorney, Agent, or Firm*—N. A. Camasto; B. W. Sufrin

[57] ABSTRACT

An electrical connector housing for removably retaining an electrical contact consisting of a dielectric body with a passageway having a flexible latch which cooperates with a forward stop and abutment shoulders to lock the contact in the housing without interfering with the termination section of the contact.

6 Claims, 7 Drawing Figures

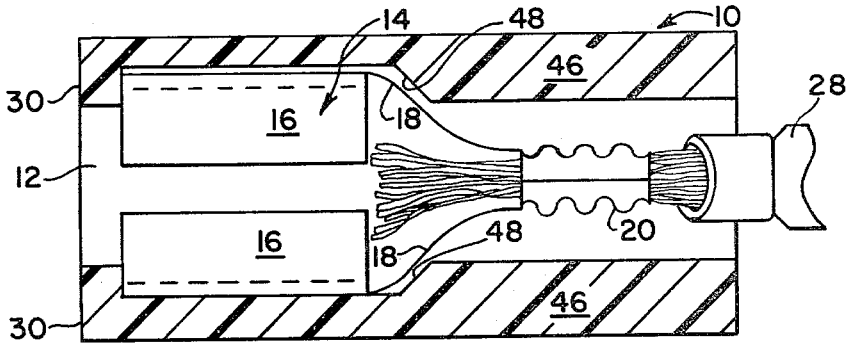
FIG. 3a
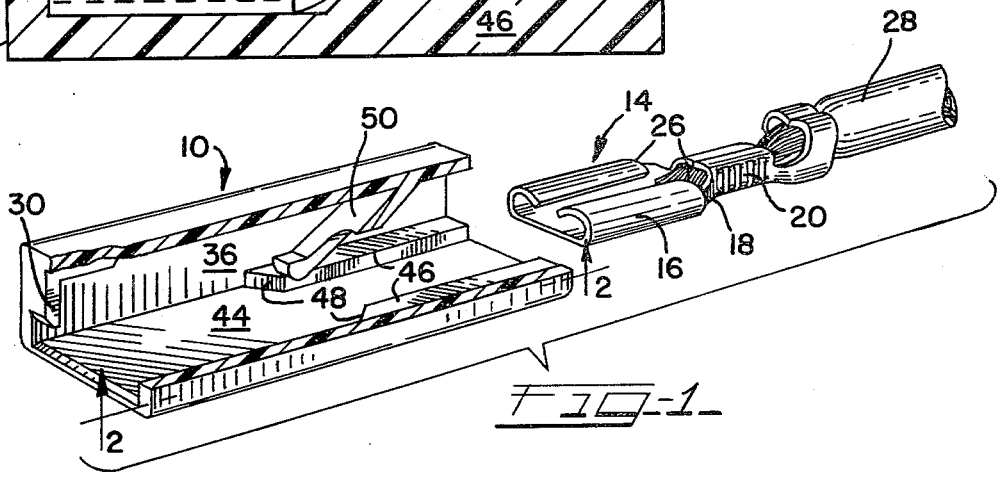
FIG. 1
FIG. 2
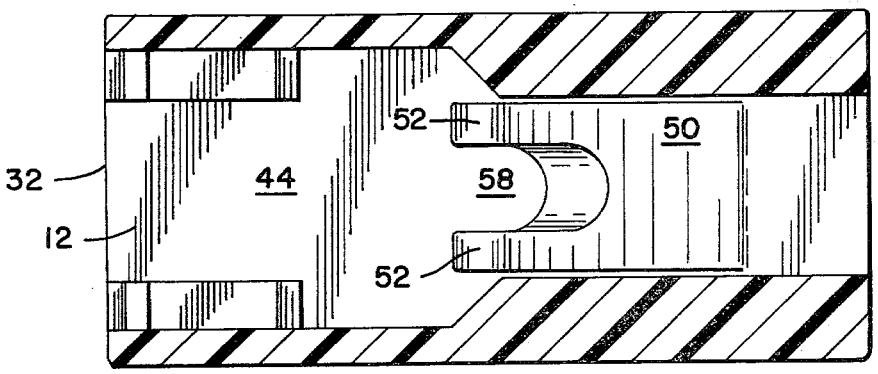
FIG. 3
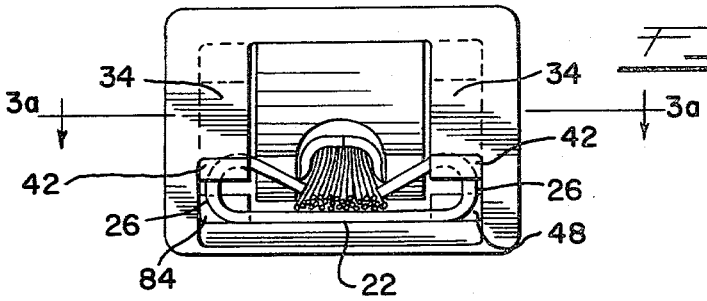

28
14
18
26
12
24
56
46
48
52
54
44
38
36
30
32
42
40

ELECTRICAL CONNECTOR HOUSING

This is a continuation, application of application Ser. No. 949,843, filed Oct. 10, 1978, now abandoned.

BACKGROUND OF THE INVENTION

This invention relates generally to electrical connectors and, more particularly, to electrical connectors of the type having a housing adapted to removably mount an electrical contact for mating with a complimentary contact. Such electrical connectors generally include one or more passageways into which contacts are inserted and thereafter removably retained by a variety of locking elements.

In recent years, a great variety of low cost electrical connectors have been developed, particularly for use in home appliances, wherein one-piece molded housings are employed to mount one or more electrical contacts. The connectors must be field servicable, and, therefore, the housings generally include means for releasably locking the contacts in place after termination to an appropriate conductor. Flexible latching means are conventionally utilized to engage a rear portion of the electrical contact after it is fully inserted into the housing.

One significant problem encountered with such prior art connectors is that the latching means are relatively thin and weak in order that they may provide the necessary flexure required during insertion of the electrical contact into the passageway. Thus, a rearward pullout force applied to a retained contact has the tendency to bend or break the latching means resulting in an undesirable or inadvertent removal of the electrical contact from the housing. Examples of typical prior art connectors relying exclusively upon thin flexible stop means are disclosed in U.S. Pat. Nos. 3,971,613 and 4,013,331.

Another difficulty encountered in the prior art connectors results from the configuration of the electrical contacts mounted therein. These contacts typically include a forward engagement section and a rearward termination section retaining a conductor in a crimp termination. This crimp termination bulges above the surface of the engagement section thereby interfering with the operation of the connector latching means and impairing the reliability of the contact retention within the connector housing.

Finally, prior art connector housings of the present type often have complex internal configurations which require side coring in molding. Side coring increases both tooling costs and material waste making such connectors unduly expensive and therefore impractical for many applications.

SUMMARY OF THE INVENTION

Accordingly, it is an important object of the present invention to provide an electrical connector housing in which electrical contacts are removably retained in a manner which resists inadvertent removal due to rearward forces applied to retained contacts.

Another object of the present invention is to provide an electrical connector housing in which electrical contacts with bulging crimp terminations do not interfere with operation of latching means carried by the housing.

A further object of the present invention is to provide an electrical connector housing which can be molded in a straightforward single action injection molding process and without reliance upon side coring.

The electrical connector housing of the present invention includes a dielectric body having a passageway for removably retaining an electrical contact. The passageway has a forward stop at its forward or mating end, a flexible latching means extending into the passageway and at least one abutment shoulder on the bottom wall of the passageway spaced from the forward stop a distance generally equal to the length of the contact engagement section. The abutment shoulder is spaced from one side wall of the passageway a distance less than the width of the contact engagement section and greater than the width of the contact termination section.

The forward stop prevents forward movement of the contact within the passageway while the abutment shoulders limit rearward movement. The latching means both engages the contact engagement section to resist rearward forces applied to the contact and exerts a downward force on the contact. The contact is thus held in place against the bottom wall of the passageway and in engagement with the abutment shoulders by the biasing force of the latching means. Thereby improving the ability of the electrical connector to resist rearward forces applied to the contact.

In one important embodiment of the invention, the flexible latching means includes two arms in spaced relationship for engaging the contact while straddling the bulging crimp termination of the contact termination.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the several figures and in which:

FIG. 1 is an exploded, perspective and partially sectioned view of the electrical connector housing of the present invention showing an electrical contact poised for insertion therein;

FIG. 2 is a plan section view taken along line 2—2 of FIG. 1 in which the contact is shown in fully inserted position;

FIG. 3 is a front elevational view of the electrical connector housing illustrated in FIG. 1 with a contact therein;

FIG. 3*a* is a plan section view taken along line 3*a*—3*a* of FIG. 3 in which the latching means have been removed to improve clarity;

DESCRIPTION OF THE PREFERRED EMBODIMENT

Figures 4, 5, 6:
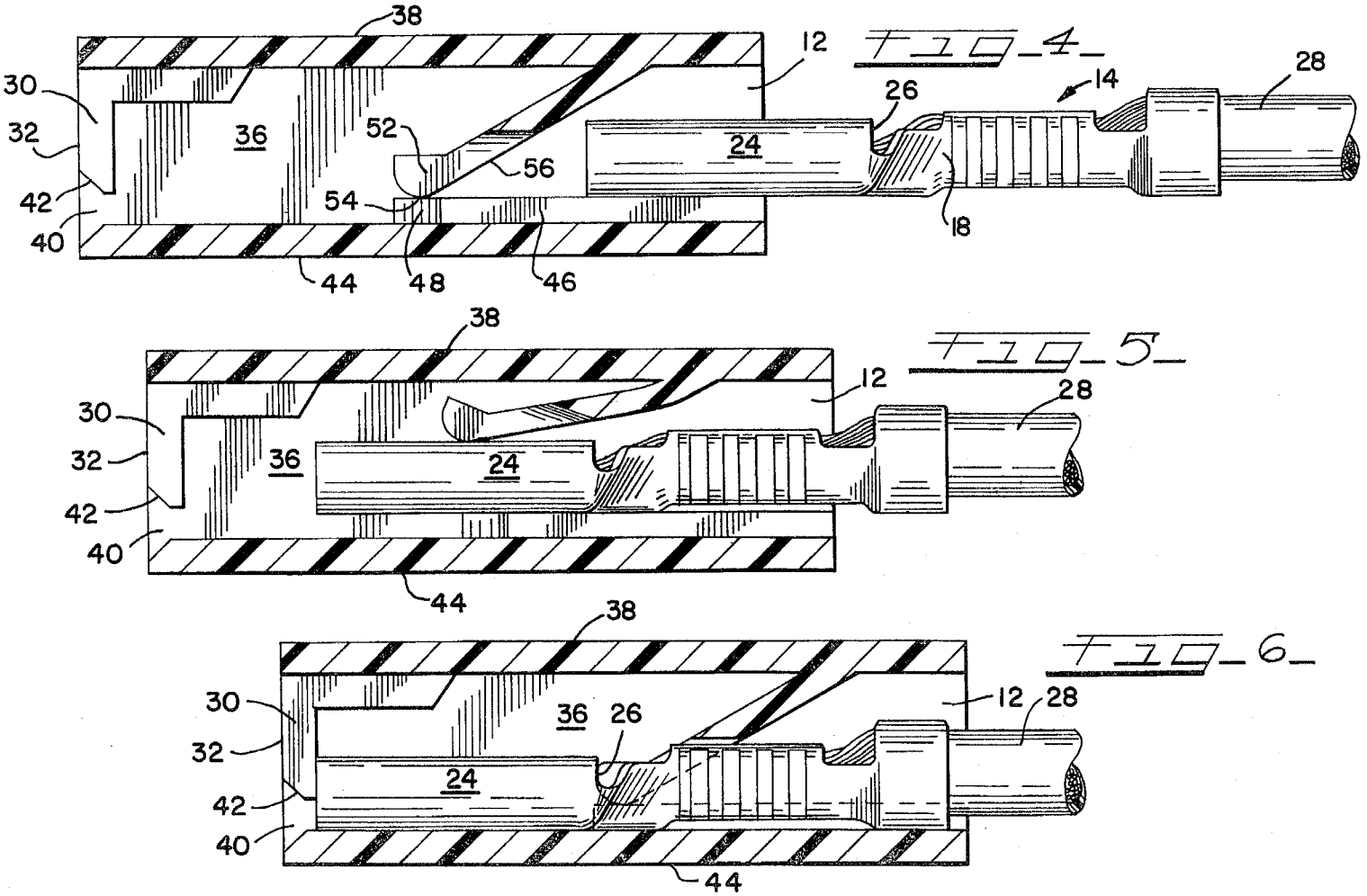
FIGS. 4, 5 and 6 are section views taken along line 4—4 of FIG. 1 showing the sequence of insertion of an electrical contact into the connector housing.

Turning now to FIG. 1, the electrical connector housing 10 is illustrated. Housing 10 is molded of resilient dielectric material such as NYLON and has a passageway 12 of substantially rectangular dimension. Housing 10 may be manufactured by conventional molding techniques such as single-action injection molding. A female electrical contact is poised for insertion within housing 10. Electrical contact 14 comprises a forward engagement section 16 which narrows to a rearward termination section 20. Contact shoulders 18 are disposed generally between the engagement and termination sections. Engagement section 16 has a base 22 and spring rolls 24 curving inwardly to the base and disposed on either side of engagement section 16. The spring rolls have rear edges 36. Termination section 20 is preferably secured to an electrically conductive insulated wire 28 by conventional crimping techniques.

Passageway 12 of housing 10 has a stop means 30 adjacent its mating end 32. Stop means 30 comprises forward stop members 34 integral with the sidewalls 36 and top wall 38 of the housing. The stop means extend downwardly from top wall 38 in substantially parallel alignment to a medial point along the sidewalls 36, thereby defining an opening 40 between the bottom edges 42 of the forward stop members 34 and the bottom wall 44. Opening 40 accommodates insertion of a complimentary electrical contact into the connector housing to engage the electrical contact supported within the housing passageway. Stop members 34 of stop means 30 are beveled at their bottom edges and spaced from bottom wall 44 to accommodate insertion of the complimentary contact.

Disposed rearwardly from the mating face of the housing 10 along the passageway 12 are abutment shoulders 46 with beveled faces 48. The abutment shoulders are located at the intersection or juncture of sidewalls 36 and a bottom wall 44 and extend from the rear of the passageway to end in the beveled faces 48 spaced from mating end 32 of the passageway. The abutment shoulders 46 are substantially parallel to each other and separated by a distance slightly smaller than the width of engagement section 16 of contact 14.

Turning now to FIGS. 2, 4 and 6, there is illustrated a flexible bifurcated latching means 50 terminating in two spaced arms 52 extending obliquely into passageway 12 and directed generally toward mating end 32 and bottom wall 44 of housing 10. Latching means 50 is formed integrally with housing 10 and is upwardly deflectable. Arms 52 are spaced from each other a distance sufficient to define a clearance opening 58 wide enough to straddle contact termination section 20 thereby preventing interference between the latching means and the contact termination section. In its free-standing position, forward tips 54 of arms 52 are spaced from passageway bottom wall 44 a distance less than the height of contact spring rolls 24 of the contact thereby resisting inadvertent rearward removal of the contact, as well as biasing the contact against bottom wall 44. The latching means 50 is formed integrally with the housing 10 and, because of its configuration and dimension, is resilient and laterally deflectable.

Housing 10 is designed to be molded in a single-action injection molding procedure. In this procedure, a pin enters the mold from the front, as seen in FIG. 3, clearing stop members 34, and cooperating with another pin entering from the rear of the mold cavity to form both the latching means and the abutment shoulders. Side coring is thus not required which means that the maximum number of cavities can be obtained per mold and the maximum number of housings produced per molding cycle.

Electrical contact 14 may be inserted into passageway 12 and retained housing 10 in alignment with housing opening 40 by the combined action of stop means 30, latching means 50 and abutment shoulders 46. This may be accomplished by inserting the electrical contact into the passageway, so that it initially contacts the rearward face 56 of flexible latching means 50 (FIG. 4) and then deflects the latching means out of the way (FIG. 5) as it proceeds into the passageway. When the leading edge of the electrical contact meets stop means 30 (FIG. 6), contact shoulders clear and fall into place behind beveled faces 48 of abutment shoulders 46 (FIG. 3*a*) and the contact snaps into the desired position under the urging of latching means 50.

Since the removal forces to which the contact is likely to be subjected will be primarily longitudinally directed, abutment shoulders 46 cooperate with flexible latching means 50 to withstand inadvertent removal of the contact from the housing. If removal of the contact is desired, however, this may be accomplished by inserting a conventional flat bladed tool (not shown) through the rear entrance of the passageway to upwardly deflect the latching means thereby permitting contact shoulders 18 to be raised out of the way of the abutment shoulders 46 and the contact to be withdrawn from the passageway.

While a particular embodiment of the invention has been shown and described, it will be obvious to those skilled in the art that changes and modifications may be made therein without departing from the invention in its broader aspects, and therefore, the objects in the appended claims are to cover all such changes and modifications which fall within the true spirit and scope of the invention.

I claim:

1. An electrical connector housing for retaining an electrical contact having a forward engagement section, a rearward termination section and contact shoulders disposed between the engagement and termination sections, the housing comprising:

a dielectric body having a passageway for receiving a contact, said passageway being defined by a bottom wall, a top wall and two side walls;

a forward stop positioned at the mating end of said passageway to limit forward movement of a contact inserted therein;

an abutment shoulder within said passageway positioned on said bottom wall at a distance to the rear of said forward stop generally equal to the length of the contact engagement section and at a distance from one side wall generally less than the width of the contact engagement section and greater than the width of the contact termination section, said abutment shoulder limiting rearward movement of the contact; and flexible latching means deflected by the contact engagement section during insertion of the contact into said passageway, for engaging the contact without interference from the contact termination section, said latching means biasing the engagement section against said bottom wall within the space defined by said forward stop and said abutment shoulder, said latching means further cooperating with said abutment shoulder and said forward stop to retain the contact within said passageway.

2. The electrical connector housing of claim 1 wherein said flexible latching means includes two arms in spaced relationship to each other for engaging the contact while straddling the contact termination section to prevent interference between said flexible latching means and the contact termination section.

3. The electrical connector of claim 2 wherein the engagement section includes a base with spring rolls curving inwardly to the base, and said latching means engage a rear edge of the spring rolls.

4. The electrical connector housing of claim 3 wherein two abutment shoulders are employed, said abutment shoulders being positioned at either intersection of a side wall and said bottom wall, said abutment shoulders being separated by a distance generally less than the width of the contact engagement section and greater than the width of the contact termination section.

5. An improved electrical connector housing for retaining an electrical contact having a forward engagement section, a rearward termination section and contact shoulders disposed between the engagement and termination sections, the housing having a dielectric body with a passageway for receiving a contact, the passageway being defined by a bottom wall, a top wall and two side walls, the passageway further having a forward stop positioned at its mating end to limit forward movement of a contact inserted therein and flexible latching means for retaining the contact in the passageway, the improvement comprising:

abutment shoulders within the passageway positioned at the intersection of said bottom wall with either a side wall at a distance to the rear of the forward stop generally equal to the length of the contact engagement section, said abutment shoulders being separated by a distance generally less than the width of the contact termination section, said abutment shoulders co-operating with the latching means to retain the contact within the passageway.

6. An electrical connector housing for retaining an electrical contact having a forward engagement section, a rearward termination section, contact shoulders disposed between the engagement and termination sections and a base with spring rolls curving inwardly to the base, the housing comprising:

a dielectric body having a passageway for receiving a contact, said passageway being defined by a bottom wall, a top wall and two side walls;

a forward stop positioned at the mating end of said housing to limit forward movement of a contact inserted therein;

an abutment shoulder within said passageway positioned on said bottom wall at a distance to the rear of said forward stop generally equal to the length of the contact engagement section and at a distance from one side wall generally less than the width of the contact engagement section and greater than the width of the contact termination section, said abutment shoulder limiting rearward movement of the contact; and flexible latching means, attached at their rearward end to said top wall and extending obliquely into said passageway toward the mating end thereof, for engaging the contact without interference from the contact termination section, said latching means including two arms in spaced relationship to each other for engaging the rear edges of the contact spring rolls while straddling the contact termination section, said latching means biasing the engagement section against said bottom wall within the space defined by said forward stop and said abutment shoulder, said latching means further co-operating with said abutment shoulder and said forward stop to lock the contact within said passageway.

* * * * *